United States Patent [19]

Hughes et al.

[11] Patent Number: 5,003,701

[45] Date of Patent: Apr. 2, 1991

[54] MASONRY CLIP

[76] Inventors: Robert J. Hughes, 3 S. Maryland Ave., Wilmington, Del. 19804; Robert C. Williams, 2814 N. Market St., Wilmington, Del. 19802

[21] Appl. No.: 338,588

[22] Filed: Apr. 14, 1989

Related U.S. Application Data

[63] Continuation-in-part of Ser. No. 174,152, Mar. 28, 1988, abandoned.

[51] Int. Cl.[5] ..... G01C 15/10

[52] U.S. Cl. ..... 33/409; 33/404

[58] Field of Search ..... 33/404–410

[56] References Cited

U.S. PATENT DOCUMENTS

| | | | |
|---|---|---|---|
| 847,824 | 3/1907 | Roberts | 33/409 |
| 1,094,286 | 4/1914 | Winstead | 33/409 |
| 2,623,290 | 12/1952 | Kampel | 33/409 |
| 2,806,290 | 9/1957 | Tiefel | 33/408 |
| 2,949,673 | 8/1960 | Belcher | 33/410 X |
| 3,039,196 | 6/1962 | Jernigan | 33/410 X |
| 3,183,595 | 5/1965 | Jopperi | 33/408 |
| 3,389,471 | 6/1968 | Blake | 33/406 |
| 4,443,395 | 4/1984 | Clark | 33/404 |

*Primary Examiner*—John E. Murtagh

*Attorney, Agent, or Firm*—Connolly & Hutz

[57] ABSTRACT

A masonry clip used to align successive courses of bricks when laying an internal wall comprising an extension attached to form a right angle to a retainer leg with a slot cut into the extension to permit the visual alignment of the clip tied to a guide line on predetermined marks on expendable furring strips set in place behind the wall being laid.

2 Claims, 2 Drawing Sheets

MASONRY CLIP

CROSS REFERENCE TO RELATED APPLICATION

This application is a continuation-in-part of our prior U.S. application Ser. No. 174,152 filed Mar. 28, 1988 now abandoned.

BACKGROUND OF THE INVENTION

Field of the Invention

This invention relates to masonry guides used in the brick laying and in a process for laying internal brick walls.

Description of Prior Art

The use of masonry guides for alignment of successive courses of brick are well known.

The use of the existing masonry guides and methods for laying internal brick walls generally are not operative. My masonry guide clip can be used for laying internal brick walls especially those with internal corners. The clip has a retainer leg which can engage an expendable furring strip, an extension leg having an elongated slot which is used for attaching a guide line and for visual alignment of the clip on guide marks on the furring strip. The guide line is formed by tying a clip on each end on the guide line which is generally a heavy duty string.

Our invention also comprises a method particularly for laying internal brick wall which meets another internal brick wall to form a corner or meet another wall to form an internal corner.

SUMMARY OF THE INVENTION

The invention is directed to a masonry guide clip used for laying internal brick walls against internal walls comprising a retainer leg attached at right angles to an extension having a slot disposed with its longitudinal axis perpendicular to the retainer leg wherein the slot provides a means for attaching a guide line and for visual adjustment of the clip on predetermined guide marks on an expendable furring strip disposed behind the brick wall being laid.

This invention is also directed to a process for aligning each course of bricks when laying an internal brick wall along an internal wall comprising securing a left vertical expendable furring strip and a right vertical expendable furring strip behind the internal brick wall to be laid; each said furring strip has predetermined guide marks for alignment of each successive course of bricks; and a guide line slidably attached at opposite ends thereof to a furring strip by means of clips of this invention wherein the guide line is aligned for each successive course of brick by sliding each clip to a predetermined mark on the furring strip said mark being visible through the slot in the clip.

DETAILED DESCRIPTION OF THE INVENTION

Figure 6:
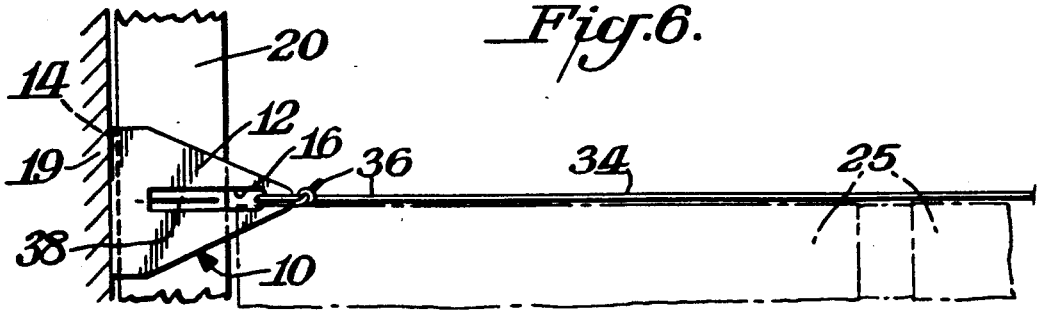
FIG. 6 is a front elevational view of a partially erected brick wall having a furring strip, a clip of FIG. 1 to which is attached the guide line.

Referring now to the drawings, the masonry guide clip 10 comprises an extension leg 12 consisting of a flat section of sheet metal which can be rectangularly or triangularly shaped and preferably is triangularly shaped. Attached to the base of the extension leg is a retainer leg 14 which engages the furring strip. An elongated slot 16 is cut into the extension leg a manner that the longitudinal axis of the slot is perpendicular to the plane formed by the retainer leg. The slot serves two purposes: (1) The guide line is attached to the clip by being threaded through the edge of the slot and securely tied and (2) the edge of the slot is used to visually align the clip holding the guide line to predetermined marks on the furring strip. The slot has a near end close to the retainer leg 14 and a far end at the opposite end of the slot. The guide line 34 is attached to the extension leg 12 at the far end of the slot, as best shown in FIG. 6 of the drawing.

The courses for internal brick walls and internal brick walls with internal corners are difficult to align. Our invention allows a brick layer to easily align the courses when laying these walls. Using our method, the first step is set into place furring strips which are generally 1"×2" wood stakes having a length of the brick wall to be laid, on a line which will be the rear of the wall being laid. The furring strips can be nailed into the wall against which a brick wall is being laid. The strips are expendable because they are not removed from the rear of the wall being laid.

Next, the guide line is attached to the furring strips. The guide line comprising 1 or 2 clips and a guide line is held in place by friction and/or pressure on the furring strips by the mechanical forces created by stretching the guide line. The two ends of guide line are attached to separate clips by tying an end of the guide line to a clip through the slot. The guide line has a small amount of elasticity and is stretched between the furring strips. The clips are held in place on the furring strips mechanically by friction and/or pressure and the elastic force created by stretching the guide line. The guide line will slide on the furring strip for positioning over a predetermined mark. The slot allows one to see the mark for accurate positioning. For example, one of the edges of the slot can be used to align the guide line to the mark.

Referring to FIG. 1, FIG. 2, FIG. 3, FIG. 4, and FIG. 6 the clip 10 of this invention is further shown. The clip has an extension 12 attached to a retainer leg 14. The extension and retainer leg form substantially a right angle. A slot 16 is cut into the extension as described above.

Figure 4:
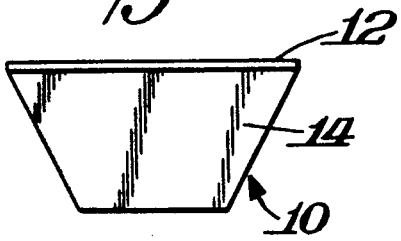
FIG. 4 is a top plan view of the clip of FIG. 1.
Figure 1:
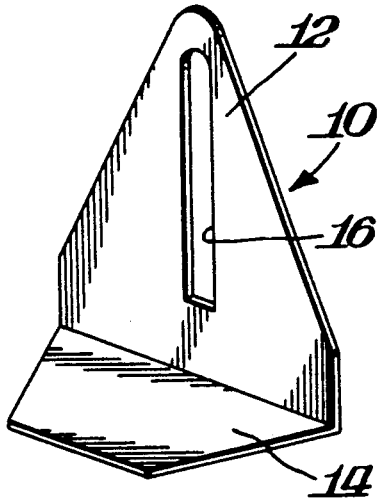
FIG. 1 is a pictorial view of the masonry guide clip of the present invention.
Figure 3:
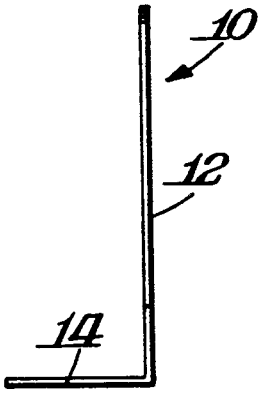
FIG. 3 is a side elevational view of the clip of FIG. 1.
Figure 2:
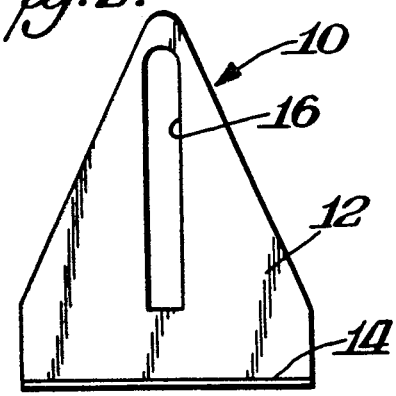
FIG. 2 is a front elevational view of the clip of FIG. 1.
Figure 5:
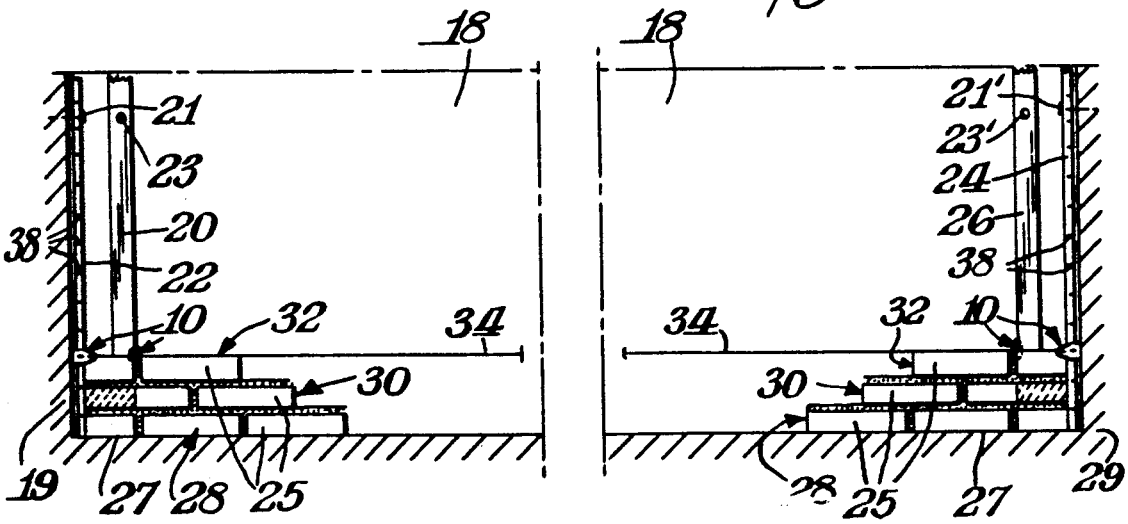
FIG. 5 is a side elevational view in cross-section of a partially erected brick wall having furring strips and line level clips of FIG. 1.
Figure 7:
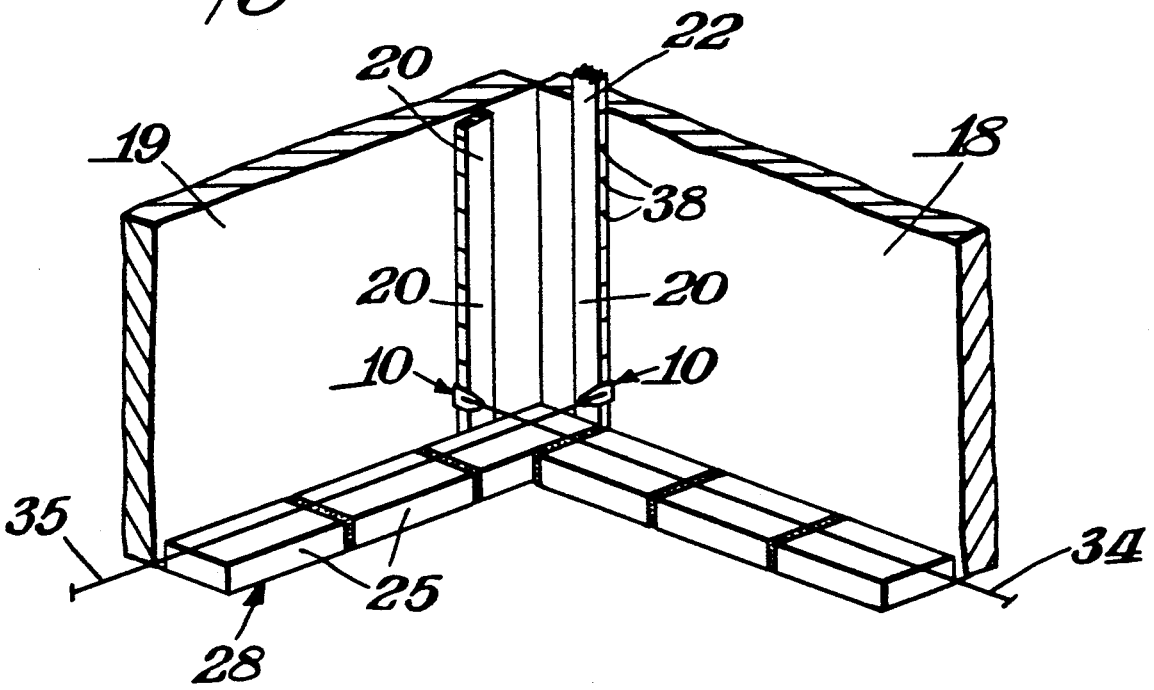
FIG. 7 is a pictorial view of a partially erected brick veneer wall having an internal corner with the clips of FIG. 1 with guide lines positioned on expendable furring strips.

In FIG. 5, FIG. 6, and FIG. 7 the use of the clip 10 is shown. Expendable furring strips are positioned on the internal wall 18. The brick wall to be laid upon a base 27 is shown with the first two courses 28 and 30 of brick 25. The third course 32 of bricks is being aligned by means of the guide line 34. The guide which can be a string is tied by a knot 36 at each end thereof to a clip of this invention.

Left furring strips 22 and right furring strip 24 are nailed into the internal walls 19 and 29 near the corners thereof positioned in a manner that the guide line placed between opposite furring strips permit the next course of brick to be aligned. For example, to align the courses of brick against wall 18 furring strips 22 and 24 which are attached to adjacent walls 19 and 29 by means of nails 21 and 21' are used. Furring strips 22 and 24 which are attached to wall 18 by means by nails 23 and 23' are used with other furring strips not shown to align the courses of brick in front of wall 19 and 29 respectively. A mark 38 which is made for each course of bricks is placed on the furring strip. As stated above, the slot in the clip allows the visual placement of the clip over the mark through the slot.

FIG. 7 further shows the use of the clip to form an internal corner. The first course 28 of bricks is shown for the corner. A second guide line 35 is positioned to align the brick for the brick wall against internal wall 19.

We claim:

1. In combination, a masonry clip and flexible guide line for aligning successive courses of bricks when laying an internal brick wall, and a pole having predetermined reference marks thereon for successive courses of bricks arranged perpendicular to the guide line, the clip comprising a generally planar retainer leg for securing the clip in place and an integrally attached generally planar extension substantially forming a right angle with the retainer leg, the extension having a longitudinal slot therein and the slot having a longitudinal axis perpendicular to the retainer leg, the slot having a near end close to the retainer leg and a far end at the opposite end thereof, and one end of the flexible guide line extending through the slot and attached to the extension at the far end of the slot whereby the guide line may be pulled taut to form an extension of the slot so that the predetermined reference marks on the pole are viewable through the slot for alignment with the guide line.

2. A combination as in claim 1 wherein the generally planar extension of the masonry clip is triangularly shaped.

* * * * *